US006276272B1

(12) United States Patent
Takami et al.

(10) Patent No.: US 6,276,272 B1
(45) **Date of Patent: *Aug. 21, 2001**

(54) STAMP PLATE PRODUCING APPARATUS FOR PRODUCING STAMP PLATE USED IN A STAMP DEVICE

(75) Inventors: Hiroshi Takami, Nagoya; Teruo Imamaki, Kasugai; Hiroshi Taira, Ichinomiya, all of (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/938,972

(22) Filed: Sep. 26, 1997

(30) Foreign Application Priority Data

Oct. 1, 1996 (JP) ..... 8-260379
Oct. 16, 1996 (JP) ..... 8-273208
Oct. 16, 1996 (JP) ..... 8-273788

(51) Int. Cl.[7] ..... B41K 1/50; B41J 2/345

(52) U.S. Cl. ..... 101/401.1; 101/327; 101/333; 347/206

(58) Field of Search ..... 101/103, 104, 101/108, 109, 327, 328, 333, 368, 401.1; 400/120.09; 347/206

(56) References Cited

U.S. PATENT DOCUMENTS 4,226,886 * 10/1980 Lakes ..... 101/333
4,392,425 * 7/1983 Capezzuto et al. ..... 101/327
4,497,275 * 2/1985 Johnson et al. ..... 118/268
4,927,695 * 5/1990 Ooms et al. ..... 101/333
5,491,503 * 2/1996 Fuwa ..... 101/128.4
5,534,906 * 7/1996 Yamada et al. ..... 347/171
5,577,444 * 11/1996 Toyama ..... 101/327
5,611,279 * 3/1997 Ando et al. ..... 101/401.1
5,741,459 * 4/1998 Ando et al. ..... 101/333
5,829,352 * 11/1998 Taira et al. ..... 101/327
5,945,202 * 8/1999 Ando ..... 101/401.1
5,970,868 * 10/1999 Kimura et al. ..... 101/125
6,000,335 * 12/1999 Imamaki et al. ..... 101/333

FOREIGN PATENT DOCUMENTS 957 303 1/1957 (DE) .
2-228-787 12/1974 (FR) .
1-442-521 7/1976 (GB) .
7-125397 5/1995 (JP) .
8-104048 4/1996 (JP) .

* cited by examiner

*Primary Examiner*—Stephen R. Funk
(74) *Attorney, Agent, or Firm*—Oliff & Berridge, PLC

(57) ABSTRACT

Disclosed is the stamp device 11 in which the average pore diameter of the porous base plate used for the stamp plate 1 and the processed stamp plate 10 is set in a range of 10 μm–40 μm, the hardness of the stamp surface 2 is set in a range of 20°–50°, the thickness of the porous base plate is set in a range of 1 mm–4 mm, and the annealing temperature of the porous base plate is set in a range of 40° C.–60° C., thereby various stamping characteristics are improved.

7 Claims, 20 Drawing Sheets

FIG.10

[μm]

| QUALITY \ AVERAGE PORE DIAMETER | LESS THAN 10 | 10 | 20 | 30 | 40 | 50 | 60 |
|---|---|---|---|---|---|---|---|
| MELTING CHARACTERESTIS | ○ | ○ | ○ | ○ | △ | △~× | × |
| STAMP CONCENTRATION | △ (LESS THAN 0.75) | △ (0.75) | ○ (0.85) | ○ (1.0) | ○ (MORE THAN 1.0) | ○ (MORE THAN 1.0) | ○ (MORE THAN 1.0) |

FIG.11

[ · ]

| QUALITY \ HARDNESS | 10 | 20 | 30 | 40 | 50 | 60 | 70 | |
|---|---|---|---|---|---|---|---|---|
| DEFORMATION OF FIGURE PORTION WHEN MELTING | × | △ | ○ | ○ | ○ | ○ | ○ | VISUAL OBSERVATION |
| MELTING CHARACTERISTIC | △ | △ | ○ | ○ | ○ | ○~△ | △ | VISUAL OBSERVATION |
| STAMPING LOAD FORCE | 3kgf ○ | 3.5kgf ○ | 4kgf ○ | 4kgf ○ | 5kgf △ | 6kgf × | 9kgf × | CONCENTRATION VALUE ABOUT 0.8 |

FIG.12

| QUALITY \ THICKNESS | LESS THAN 1mm | 1.6mm | 2mm | 4mm | 6mm |
|---|---|---|---|---|---|
| STAMP SURFACE STRENGTH (PARTIAL CONTACT BY THERMAL HEAD) | × | ○ | ○ | ○ | ○ |
| HANDLING CHARACTERISTIC | × | △ | ○ | ○ | ○ |
| COST | ○ | ○ | ○ | △ | △~× |

FIG.13

[℃]

| ANNEALING TEMPERATURE / QUALITY | LESS THAN 40 | 50 | 55 | 60 |
|---|---|---|---|---|
| STAMPING CONCENTRATION | △ | ○ | ○ | △～× |
| DIMENSION STABILITY | △～× | ○ | ○ | ○ |
| RESISTING CHARACTERISTIC | △～× | ○ | ○ | ○ |

STAMP PLATE PRODUCING APPARATUS FOR PRODUCING STAMP PLATE USED IN A STAMP DEVICE

BACKGROUND OF THE INVENTION

1. Field of the Invention

The present invention relates to a stamp device provided with a stamp plate constructed from a porous base plate wherein an ink impermeable melted-solidified portion and an ink permeable non-melted portion are formed by selectively heating and melting a stamp surface of the porous base plate having open cells through a thermal head having a plurality of dot heating elements, and a support member which supports the stamp plate from one side thereof, and more particularly to a stamp device with improved various stamping characteristics by giving various characteristics to the porous base plate used for the stamp plate.

The present invention also relates to a stamp plate producing apparatus for producing a stamp plate constructed from a porous base plate on which an ink permeable non-melted portion (figure portion) and an ink impermeable melted-solidified portion (non-figure portion) are formed by contacting a thermal head having a plurality of dot heating elements to a stamp surface of the porous base plate with ink permeability and selectively heating and melting the stamp surface of the porous base plate while moving the thermal head.

2. Description of Related Art (1) Heretofore, a number of proposals have been made regarding stamp devices each using a stamp plate constructed from a porous base plate formed of cellular plastic or rubber having open cells therein, on which an ink permeable non-melted portion and an ink impermeable melted-solidified portion are formed by selectively heating and melting a stamp surface of the porous base plate by means of a thermal head. The ink permeable non-melted portion is the portion where open cells are left according to the shape of mirror images and the like to be stamped. The ink impermeable melted-solidified portion is the portion where open cells in the portion excepting the above part forming the mirror images are melted and solidified to be sealed.

When stamping of characters and the like is conducted by using the above stamp device, ink is impregnated in the non-melted portion of the stamp plate and the stamp plate is pressed onto a stamp sheet, thereby stamping of characters is done.

By the way, in the above stamp device, it is inevitable to be able to clearly stamp characters over plural stamping times, on the basis of characteristic in the stamp device. Therefore, it is demanded the following characteristics for the stamp device. That is, the first characteristic is that the non-melted portion in the stamp plate can satisfactorily retain ink therein. The second characteristic is that the border between the melted-solidified portion and the non-melted portion can be sharply formed by means of the thermal head. The third characteristic is that edges of characters can also be clearly stamped. And the fourth characteristic is that dimension of the stamp plate can be retained for a long time.

In order to satisfy the above characteristics, pore size (diameter) formed on the basis of open cells in the porous base plate used for the stamp plate, hardness of the stamp surface, melting point and thickness of the stamp plate, must be set in a suitable range. However, it is difficult to produce the stamp plate so as to satisfy the above characteristics demanded therefor, and sufficient study on the stamp plate has not been made yet.

(2) Conventionally, as shown in FIGS. 23, 24, it is well-known a stamp device 202. The stamp device 202 has a stamp plate 200 constructed from an ink permeable porous base plate on a surface of which stamping area is formed, and a support member 201 which supports the stamp plate 200 from the back surface thereof. The stamp device 200 can continuously stamp characters through the stamping area while impregnating ink in the stamp plate 200.

Further, it is well-known a stamp plate producing apparatus in which the stamp plate 200 used for the above stamp device 202 is produced. In such apparatus, the thermal head having dot heating elements is contacted to the surface of the ink permeable porous base plate and the dot heating elements are selectively heated while moving the thermal head. Thereby, it is formed on the surface of the porous base plate a stamp surface having the ink impermeable melted-solidified portion 203 (non-figure portion) and the ink permeable non-melted portion 204 (figure portion).

By the way, when the stamp surface is formed by selectively heating the dot heating elements while moving the thermal head on the surface of the porous base plate, the border between the melted-solidified portion 203 and the non-melted portion 204 is forcedly dragged by the edge of the thermal head in case that the dot heating elements are positioned upstream the moving direction of the thermal head from the contact point between the thermal head and the porous base plate. As a result, there is a problem that the border between the melted-solidified portion 203 and the non-melted portion 204 cannot be made clear. For example, as shown in FIG. 23, the central portion of the porous base plate (stamp plate 200) is dragged and extended in the direction E by the thermal head when melted, and after the stamp plate 200 is produced, the central portion of the porous base plate is contracted in the direction F as shown in FIG. 24. Thereby, torsion occurs in the stamp plate 200.

Reversely, if the dot heating elements are positioned downstream in the moving direction of the thermal head from the contact point between the thermal head and the porous base plate, the dot heating elements cannot be uniformly contacted to the porous base plate in case that the distance between the edge of the thermal head and the dot heating elements becomes long to an extent passing the limit.

(3) As mentioned, it is conventionally known a stamp plate producing apparatus for producing the stamp plate on which an ink permeable non-melted portion (figure portion) and an ink impermeable melted-solidified portion (non-figure portion) are formed by contacting a thermal head having a plurality of dot heating elements to a stamp surface of a porous base plate with ink permeability and selectively heating and melting the stamp surface of the porous base plate while moving the thermal head.

In the thermal head, the dimension of the dot heating element in both the primary scanning direction and the secondary scanning direction is generally set so as to become smaller than the dot pitch and the feed pitch, respectively, taking into consideration ink blurring in stamping.

However, in case that the stamp surface is formed on the porous base plate by selectively melting, it is necessary to be able to form the melted-solidified portion corresponding to one dot heating element by heating one element and to form the non-melted portion corresponding to one dot heating element without heating one element.

The inventors have variously studied to realize both melting one dot area corresponding the one dot heating element and remaining thereof without melting, as a result, found that it was important to consider the relation between the melting area and the energy applied to the thermal head. For example, as shown in FIG. 20, the melting area is apt to be influenced by change of the energy in the low energy region, thus stable melting cannot be done. On the other hand, it is possible that the thermal head is broken in the high energy region. Therefore, the energy for stable melting should be in a predetermined region.

Further, considering the melting area, to completely seal the melted-solidified portion it is necessary that the melting area has the same size of the dot pitch, as shown in FIG. 21(A) and (B). On the other hand, as shown in FIG. 22, since the non-melted portion is pressed while stamping, the non-melted portion can be wholly used as the stampable area, thus if the stampable area is about 70% of the dot pitch, stamping for the one dot area can be done taking ink blurring into consideration. At that time, the melting area necessary to remain the non-melted portion of the one dot area becomes about 110% of the dot pitch.

Assuming that the thermal head is driven with the energy region capable of melting the porous base plate, the inventors found that the melting area necessary to completely seal the melted-solidified portion and to remain the non-melted portion corresponding to the one dot area became 100%–110% of the dot pitch. Based on the above, this invention was made.

SUMMARY OF THE INVENTION

The inventors of the present invention have variously studied on the porous base plate used for the stamp plate while taking the above characteristics required for the stamp device into consideration, and as a result, found out that various stamping characteristics could be improved so as to satisfy the above characteristics of the stamp device by preparing the average pore size, hardness, etc. in a predetermined range.

The present invention has been made in view of the above circumstances and has the first object to overcome the above problems and to provide a stamp device with improved stamping characteristics by giving various characteristics to the porous base plate used for the stamp plate.

The present invention also has the second object to provide a stamp plate producing apparatus in which the border between the melted-solidified portion and the non-melted portion can be clearly formed.

Further, the present invention has the third object to provide a stamp plate producing apparatus in which both the melting and remaining of the one dot area on the stamp plate can be conducted.

To accomplish the first object and in accordance with the purpose of the invention, as embodied and broadly described herein, the present invention provides a stamp device provided with a stamp plate which is constructed from a porous base plate with open cells therein having a stamp surface on which an ink impermeable melted-solidified portion and an ink permeable non-melted portion are formed, and a support member for supporting the stamp plate from one side thereof, wherein an average pore diameter formed on the basis of the open cells lies in a range of 10 μm–40 μm.

In the stamp device, since the average pore diameter is set in range of 10 μm–40 μm, the melting characteristic of the stamp surface can be improved when forming the non-melted portion and the stamp concentration of characters stamped by the non-melted portion can be stably retained. Here, it is preferable to set the average pore diameter in a range of 15 μm–25 μcm. More preferably, the average pore diameter is set to 20 μm.

The present invention also provides a stamp device provided with a stamp plate which is constructed from a porous base plate with open cells therein having a stamp surface on which an ink impermeable melted-solidified portion and an ink permeable non-melted portion are formed, and a support member for supporting the stamp plate from one side thereof, wherein hardness of the stamp surface in the porous base plate lies in a range of 20°–50°.

In the stamp device, since the hardness of the stamp surface in the porous base plate is set in a range of 20–50°, it can prevent the stamp plate from being deformed when stamping characters through the non-melted portion, thus characters can be clearly stamped. Further, when the non-melted portion is formed on the stamp surface through the thermal head, the thermal head can be uniformly contacted to the stamp surface, thus the border between the non-melted portion and the melted-solidified portion can be clearly formed. Here, it is preferable to Bet the hardness in a range of 30°–40°. More preferably, the hardness is set to 35°.

The present invention further provides a stamp device provided with a stamp plate which is constructed from a porous base plate with open cells therein having a stamp surface on which an ink permeable melted-solidified portion and an ink impermeable non-melted portion are formed, and a support member for supporting the stamp plate from one side thereof, wherein thickness of the porous base plate lies in a range of 1 mm–4 mm.

In the stamp device, since the thickness of the porous base plate is set in a range of 1 mm–4 mm, the thermal head can be uniformly contacted to the stamp surface without breaking the stamp surface when the non-melted portion is formed on the stamp surface through the thermal head, thereby the border between the non-melted portion and the melted-solidified portion can be clearly formed. Further, the stamp plate can be easily handled. Here, it is preferable to set the thickness in a range of 2 mm–2.5 mm.

Furthermore, the present invention provides a stamp device provided with a stamp plate which is constructed from a porous base plate with open cells therein having a stamp surface on which an ink impermeable melted-solidified portion and an ink permeable non-melted portion are formed, and a support member for supporting the stamp plate from one side thereof, wherein the porous base plate is annealed under a temperature lying in a range of 40° C.–60° C.

In the stamp device, since the porous base plate is annealed under the temperature lying in a range of 40° C.–60° C., the dimension of the stamp plate can be retained for a long time under this temperature range or less, thus excellent dimension stability can be given to the stamp plate under the normal circumstance. Here, it is preferable to set the temperature in a range of 45° C.–55° C.

Also, to accomplish the second object, the present invention provides a stamp plate producing apparatus for producing a stamp plate constructed from a porous base plate having a stamp surface on which an ink permeable non-melted portion and an ink impermeable melted-solidified portion are formed by contacting a thermal head with a plurality of dot heating elements at a contact point on one surface of the porous base plate with ink permeability and selectively heating and melting the surface of the porous base plate while moving the thermal head, wherein a distance between the contact point where the thermal head and the porous base plate contact and the dot heating element is set in a range of 0 mm–1.0 mm, and wherein hardness of the porous base plate lies in a range of 20°–60° under 25° C.

In the stamp plate producing apparatus, since the positional relation between the dot heating element of the thermal head and the porous base plate and the hardness of the porous base plate is set according to the above, the thermal head can be uniformly contacted to the porous base plate, thus it can prevent the torsion of figure stamped through the non-melted portion.

Here, on the basis of the following reason, the distance between the contact point where the thermal head and the porous base plate contact and the dot heating element is set in a range of 0 mm–1.0 mm. That is, the thermal head should be uniformly contacted to the porous base plate without partial contacting, to form correctly the stamp surface on the porous base plate and stamp clearly the figure. Here, it is preferable to set the distance in a range of 0 mm–0.4 mm.

Further, the hardness of the porous base plate is measured by ASKER TYPE C hardness meter. The reason that the hardness is set in a range of 20°–60° under 25° C. is as follows. If the hardness is less than 20°, the porous base plate is extended in the moving direction of the thermal head when the thermal head is contacted to the porous base plate with a predetermined contact pressure. Thus, the stamp pitch of the figure stamped by the non-melted portion on the stamp plate deviates and the torsion of the figure occurs. On the other hand, if the hardness of the porous base plate exceeds 60°, the thermal head is partially contacted to the porous base plate, thus stamping load force in stamping becomes too large.

Further, to accomplish the third object, the present invention provides a stamp plate producing apparatus for producing a stamp plate constructed from a porous base plate having a stamp surface on which an ink permeable non-melted portion and an ink impermeable melted-solidified portion are formed by contacting a thermal head with a plurality of dot heating elements at a contact point on one surface of the porous base plate with ink permeability and selectively heating and melting the surface of the porous base plate while moving the thermal head, wherein the dot heating elements are arranged on the thermal head with an arranging pitch and the dot heating element has an area capable of melting the porous base plate, the area being set in a range of 100%–110% of the arranging pitch, and wherein the dot heating element has a predetermined size in both the primary scanning direction and the secondary scanning direction and the predetermined size is set in a range of 70%–130% of the arranging pitch.

In the stamp plate producing apparatus, on the basis of the following reason, the area capable of melting the porous base plate is set in a range of 100%–110% of the arranging pitch and the size of the dot heating element is set in a range of 70%–130% of the arranging pitch. As shown in FIG. 19, considering the energy capable of melting on the basis of the energy applied to the thermal head, the size of the dot heating element necessary to completely seal the melted portion and remain the non-melted portion of the one dot area becomes in a range of 70%–130% of the dot pitch. Here, the primary scanning direction of the dot heating element means the direction perpendicular to the moving direction of the thermal head. The secondary scanning direction means the direction along the moving direction of the thermal head, the secondary scanning direction being perpendicular to the primary scanning direction.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

FIG. 10 a table showing the relation between the average pore size and melting characteristic, stamp concentration in the porous base plate;

FIG. 11 is a table showing the relation between the hardness of the porous base plate and deformation characteristic of figure portion, the melting characteristic, stamping load force while melting of the porous base plate;

FIG. 12 is a table showing the relation between the thickness of the porous base plate and strength of the stamp surface, handling characteristic, cost;

FIG. 13 is a table showing the relation between annealing temperature and the stamp concentration, dimension stability against time passage, resisting characteristic against environmental temperature;

DETAILED DESCRIPTION OF THE PREFERRED EMBODIMENTS

A detailed description of the preferred embodiments of a stamp device embodying the present invention will now be given referring to the accompanying drawings. At first, the stamp device of the first embodiment will be described.

Figure 1:
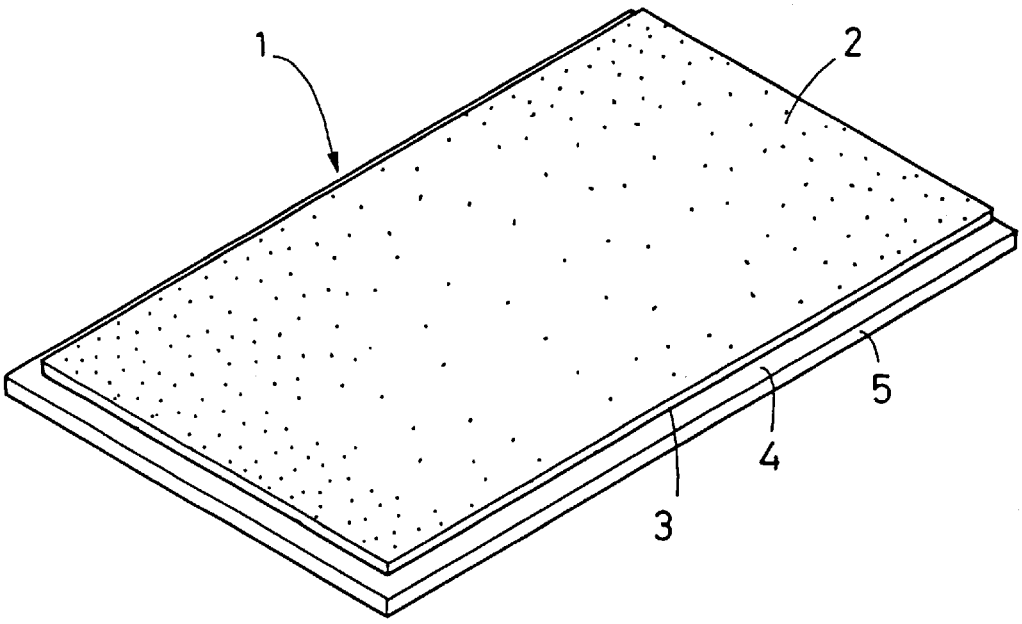
FIG. 1 is a perspective view of a stamp plate according to the first embodiment of the present invention.

A structure of a stamp plate to be used in the stamp device is first described with reference to FIG. 1. FIG. 1 is a perspective view of the stamp plate formed from a porous base plate having open cells, which is processed to make the four side faces extending between the upper and lower faces, i.e., the side thickness of the base plate, impermeable to ink.

In FIG. 1, the porous base plate forming the stamp plate 1 is made of rigid or semi-rigid rubber material having continuous fine open cells therein. Such the porous base plate can be manufactured by the following methods.

First, polybutadiene 14 weight % and dibutyl phthalate (plasticizer) 86 weight % are mixed and heated under 100–200° C. for a predetermined time. Thereafter, the mixture is poured into a plate with a mold and rapidly cooled down under normal temperature, thereby the mixture is shaped according to the plate with a mold. At that time, porous structure in the porous base plate is determined corresponding to the cooling condition. For example, when the mixture in the plate with a mold is rapidly cooled down, pore diameter (size) formed in the porous base plate due to the open cells becomes small. In the first embodiment, the mixture is cooled down under a cooling condition so that the average pore size lies in a range of 10 $\mu$m–40 $\mu$m. Thereby, the mixed solid material can be obtained.

At the time that fabrication is finished after cooling down of the mixture, dibutyl phthalate remains in polybutadiene while maintaining gel state, in the mixed solid material. Thus, it is conducted removal process for removing a predetermined amount of the plasticizer from the mixed solid material. In the removal process, the mixed solid material is taken out from the plate with a mold and pressed with predetermined pressure, thereby dibutyl phthalate in gel state is removed from polybutadiene. Through the removal process, content of dibutyl phthalate decreases in a range of 5–30 weight %.

Further, after the removal process, vacuum drying of the mixed solid material is conducted, and the mixed solid material is annealed at temperature in a range of 40° C.–60° C. Thereby, the porous base plate is obtained. Here, structure of polybutadiene in the porous base plate is stabilized by the annealing process, and dimension stability of the porous base plate is improved in a range of annealing temperature and temperature lower than such temperature range.

The thickness of the above processed porous base plate lies in a range of 1 mm–4 mm, on the basis of thickness of the plate with a mold, and it is found that the hardness in the surface (which becomes the stamp surface 2 later) of the porous base plate lies in a range of 20°–40°when measured by means of ASKER TYPE C hardness meter, and the melting point thereof lies in a range of 70° C.–130° C.

Instead of the rubber material, usable is foamed plastic made of a selected one of polyolefine resin, polyurethane resin, vinyl chloride resin, ABS resin, ethylene-vinyl acetate copolymer, and other resin, each of which is rigid or semi-rigid and has open fine cells therein. These foamed plastics may be used by removing a surface layer covering the outside of the foamed plastic after foaming, and slicing it into a flat plate. Alternatively, one plane of the foamed plastic in contact with the mold for forming the foamed plastic may be used as a stamp surface of the stamp device.

As shown in FIG. 1, to form a stamp surface 2 in a predetermined region of an upper surface of the stamp plate 1, wherein cells are visible, other portions are pressed by a heated die to form convex-shaped portions 3 and 4 and four side faces 5 below the convex-shaped portions 3 and 4 into melted-solidified portions In these melted-solidified portions 3, 4 and 5, cells are covered with a thin film layer of ink impermeability. If a back surface (a lower surface in FIG. 1) of the stamp plate 1 is left as non-melted so as to be permeable with ink, a long-term ink supply in continuous stamping operations can be achieved by attaching an ink occlusion pad to the back surface of the stamp plate 1.

Figure 2:
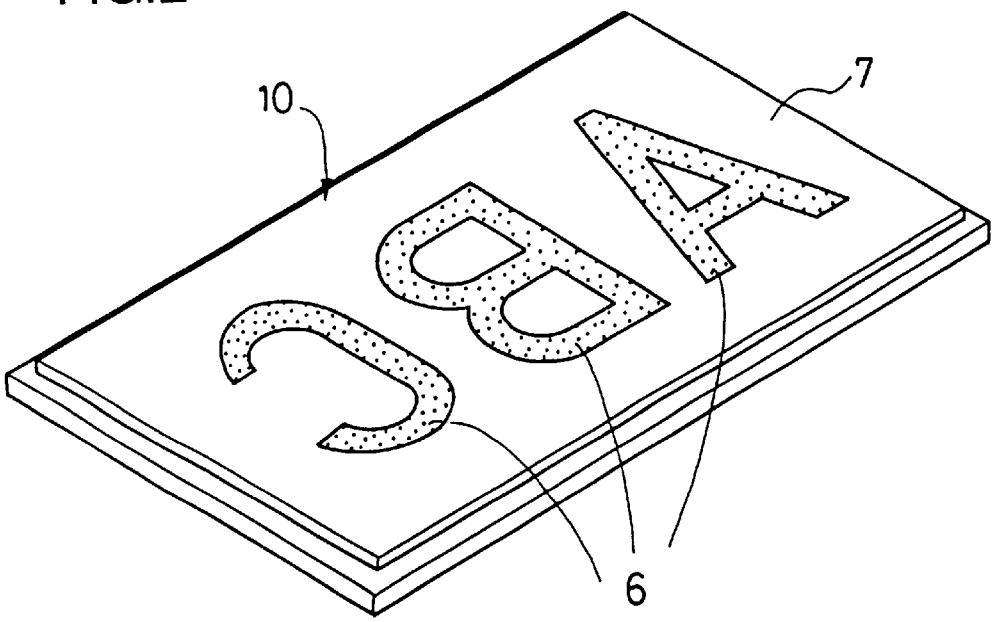
FIG. 2 is a perspective view of a processed stamp plate.

FIG. 2 is a perspective view of the stamp plate after processed on which figure portions 6 in the shape of mirror images of desired characters, figures and the like are formed on the stamp surface 2, which is referred to as a processed stamp plate 10 hereinafter. This processed stamp plate 10 is, for example, manufactured by a stamp producing apparatus 60 shown in FIG. 3 through FIG. 5.

Figure 3:
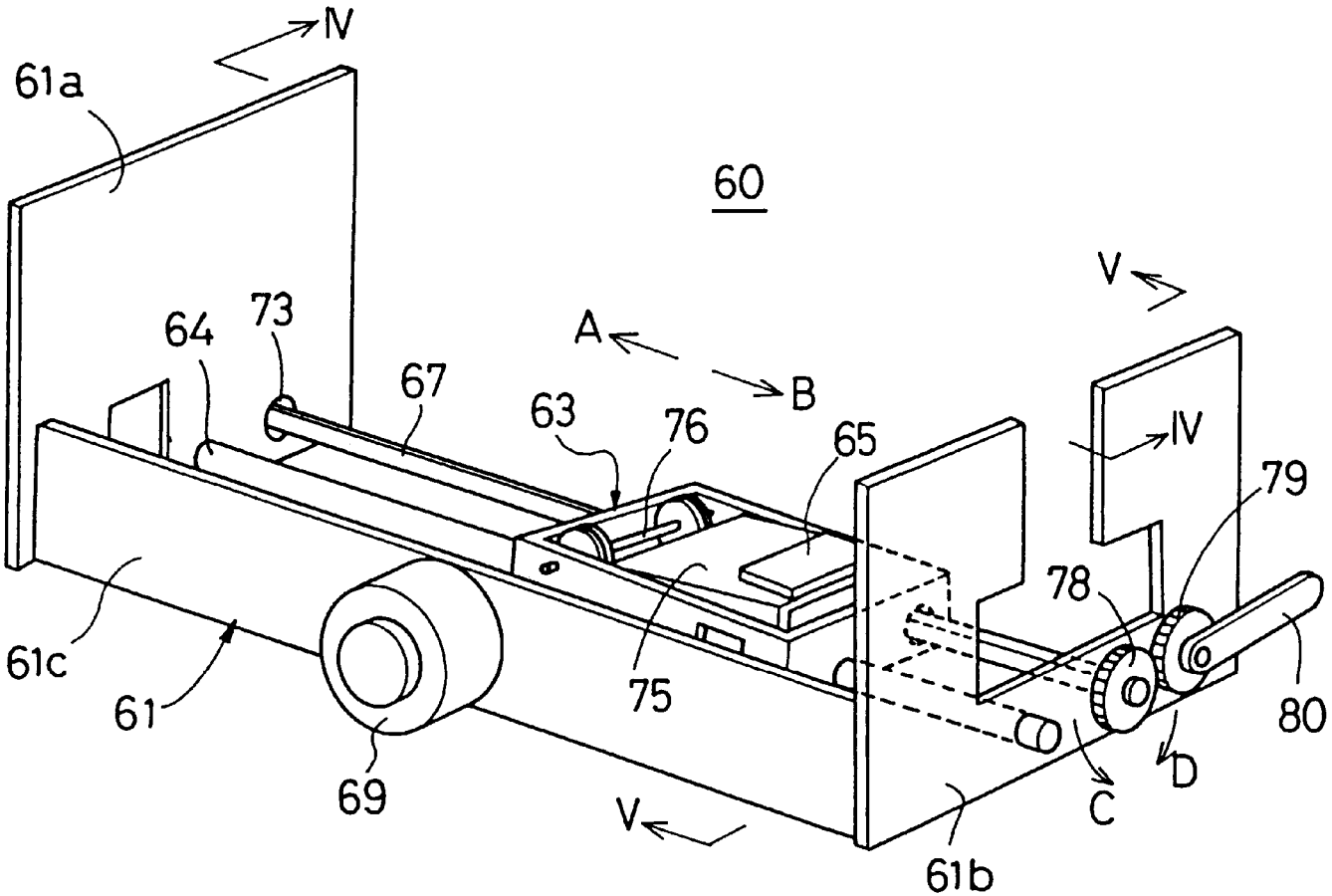
FIG. 3 is a perspective view of a main part of a stamp producing apparatus.
Figure 4:
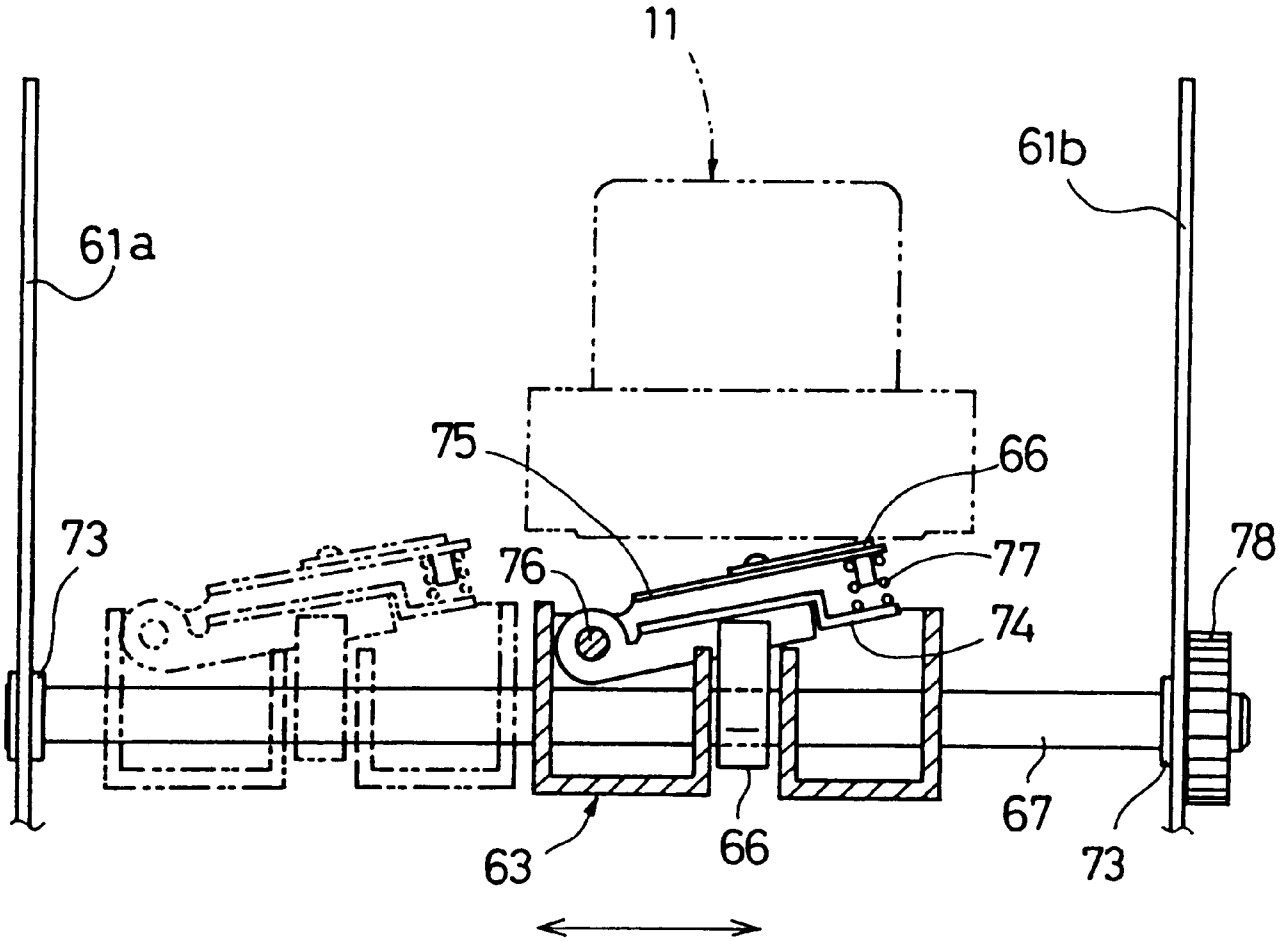
FIG. 4 is a sectional view of the stamp producing apparatus of FIG. 3 viewed along a IV—IV line.
Figure 5:
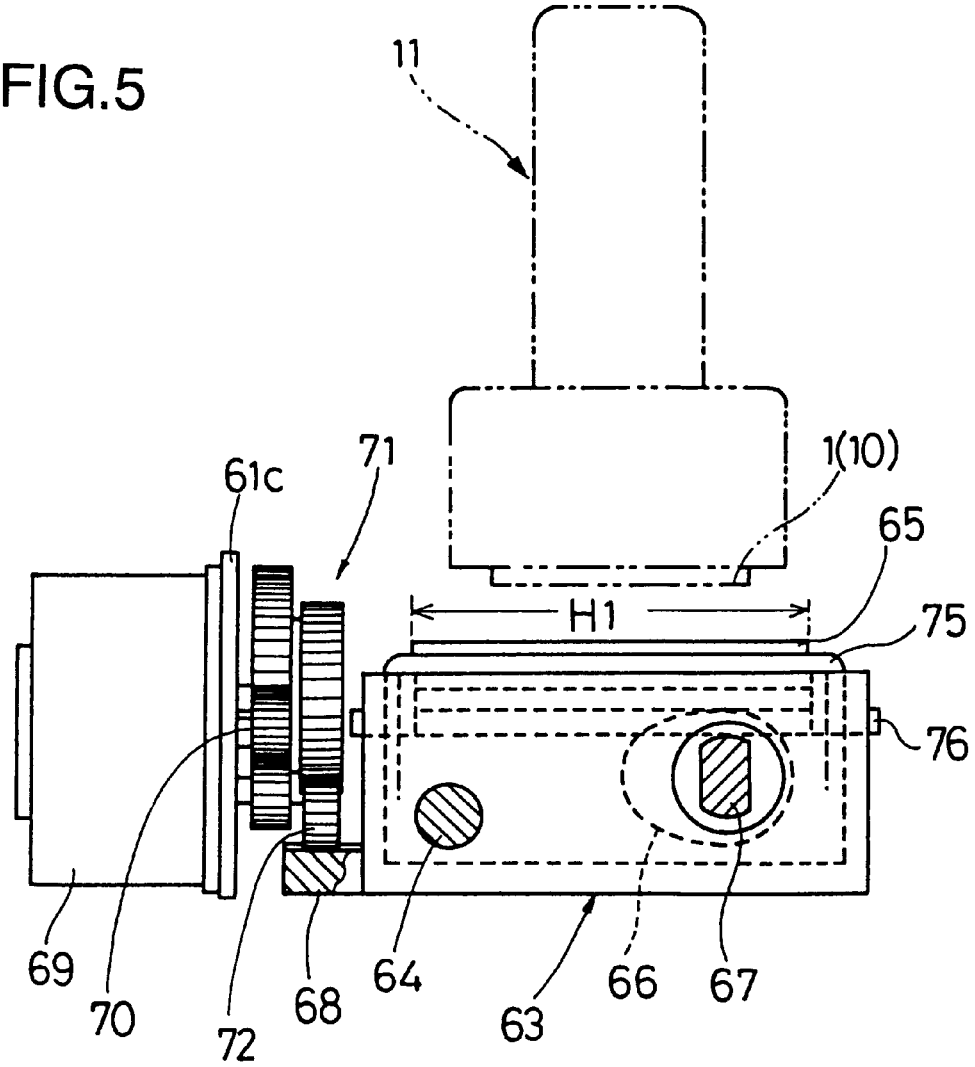
FIG. 5 is a sectional view of the stamp producing apparatus of FIG. 3 viewed along a V—V line.

In FIGS. 3 through 5, the stamp producing apparatus 60 is provided with a guide rod 64 to guide a carriage 63 in an axial direction and a head change rod 67 to guide the carriage 63 and operate a cam member 66 whereby a thermal head 65 mounted on the carriage 63 is moved up and down, both rods 64 and 67 being arranged between a right and left side walls 61*a* and 61*b* of a frame 61. The cam member 66 is mounted on the head change rod 67 so as not to be rotatable about the rod 67, but slidable in the axial direction. The head change rod 67 is rotatably supported in bearings 73 provided in the side walls 61*a* and 61*b*.

The stamp plate 1 is attached on a lower surface of a stamp device 11 mentioned later. This stamp device 11 is fixedly positioned above the moving carriage 63 by a supporting means not shown. The carriage 63 is mounted on the guide rod 64 and the head change rod 67 so as to be movable in the axial direction of the rods 64 and 67. At a front end (a left end in FIG. 5) of the carriage 63, a rack 68 having an appropriate length in a longitudinal direction of the carriage 63 is integrally fixed with an appropriate fixing means. The carriage 63 can be moved in a lateral direction (indicated by arrows A and B in FIGS. 3 and 4) by a power transmitted from a driving pinion 70 of a driving motor 69 which is reversely rotatable and fixedly mounted on a front wall 61*c* of the frame 61 through a group of reduction gears 71 arranged on a back surface of the front wall 61*c* to an engaging gear 72 which is engaged with the rack 68.

The carriage 63 is provided with a cam contact plate 74 and a heat release plate 75, both of which are mounted rotatably upward and downward about a support shaft 76 arranged in an orthogonal direction with respect to the head change rod 67, and a thermal head 65 fixed on the upper end side of the heat release plate 75. This heat release plate 75 is always pressed elastically by means of a spring 77 disposed between the cam contact plate 74 and the heat release plate 75.

The cam member 66 is formed in the shape of an ellipse or a similar shape where one axis is longer than the traverse axis or an eccentrically mounted circle, and the like, thereby to come into contact with a lower surface of the cam contact plate 74. This cam member 66 changes its position or orientation according to the rotation of the head change rod 67 as indicated by the arrows C and D in FIG. 3. When the cam member 66 is positioned sideways (shown in FIG. 5), becoming oblong in a horizontal direction with respect to the head change rod 67, the heat release plate 75 mounting the thermal head 65 thereon is put down or retracted. When the cam member 66 is positioned oblongly in a vertical direction with respect to the rod 67, i.e., in a stand-up state, causing the rotation of the cam contact plate 74 in an upward direction, the heat release plate 75 is rotated upward through the cam contact plate 74 and the spring 77, whereby the thermal head 65 is pressed against the lower surface of the stamp plate 1 fixedly positioned above the carriage 63.

The rotation of the head change rod 67 in the direction C or D to change the position of the cam member 66 is caused by means of a gear 78 mounted on an end of the head change rod 67, a gear 79 supported on the right end wall 61*b* and a lever 80 to rotate the gear 79.

The thermal head 65 has substantially the same structure as that of a well known thermal printer in which, for example, ninety-six point-like (dot) heating elements are arranged in a line in an orthogonal direction with respect to the arrow A, in which a length (H1 in the FIG. 5) of one line of the heating elements is a little longer than the width of the stamp plate 1.

The stamp producing apparatus 60 has a control unit not shown of microcomputer type including a central processing unit (cPu), a read-only memory (ROM), a random-access memory (RAM) and an interface and the like. The control unit drives the thermal head 65 and the driving motor 69. As shown in FIG. 4, the control unit controls the cam member 66 to be positioned in a stand-up state thereby to press the thermal head 65 against an end portion (an upper end in FIG. 4) of the stamp surface 2 of the stamp plate 1, and the thermal head 65 to activate all heating elements in one line, while activating the driving motor 69 to move the carriage 63 at a constant speed in the direction of the arrow A, thereby melting the part of the stamp surface 2 in contact with the thermal head 65, and then the melted part is solidified. Then a thin film which is impermeable with ink is formed on the melted-solidified part of the stamp surface 2, resulting in ink impermeable melted-solidified portion 7 (see FIG. 2). Succeedingly, in a predetermined part of the stamp surface 2, the thermal head 65 is controlled to allow the point-like heating elements not to emit heat in accordance with image dot patterns based on predetermined characters data input in advance and as a result, the predetermined part are not melted to form the figure portion 6 in the shape of mirror images of the predetermined characters as being permeable with ink, and other part becomes the melted and solidified portion 7 impermeable with ink. In this way, the finished stamp plate 10 can be manufactured. In the figure portion 6 of the processed stamp plate 10, the mean diameter of pores formed from the open cells is 10 to 40 $\mu$m.

A structure of the stamp device 11 will be described hereinafter with reference to FIGS. 6 to 9. In FIGS. 6 to 9, the stamp device 11 is constructed from the stamp plate 1 (processed stamp plate 10) in the shape of a substantially rectangular plate, a support member 12 for supporting the stamp plate 1 from the back surface. This support member 12 is rectangular in a plan view and is integrally or separately provided with a hand-hold portion 14.

Figure 6:
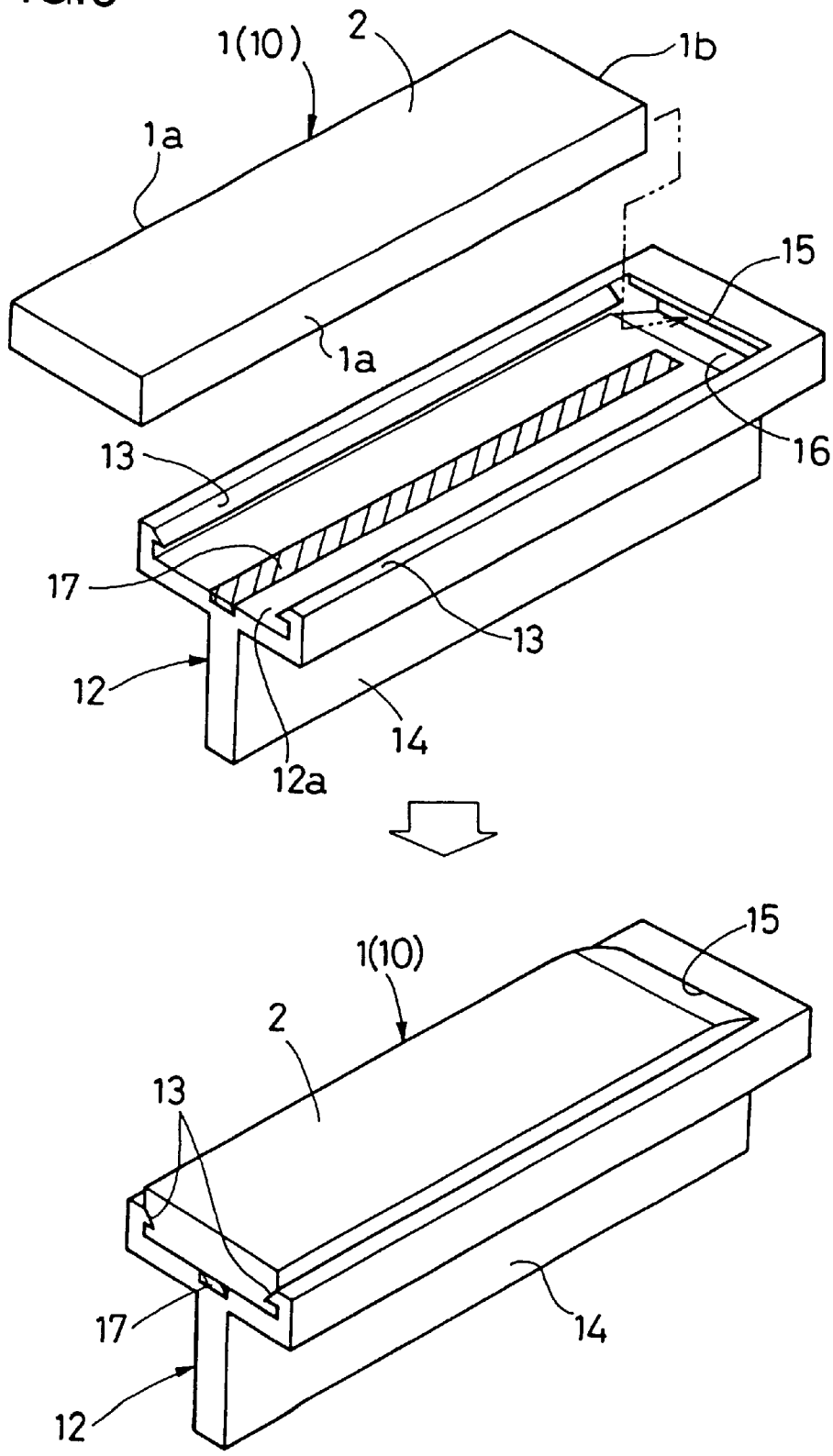
FIG. 6 is an explanatory view showing a work to assemble the stamp plate with a support member, constructing the stamp device in the first embodiment.

The support member 12 is also provided, in its surface side (i.e., an upper side in FIG. 6), with a pair of longitudinal claws 13 formed in parallel with both longitudinal side faces la of the stamp plate 1, serving as engaging means to elastically hold the stamp plate 1, and a concave slot portion 15 formed in one end of the support member 12, in which an end face 1*b* orthogonal to the side faces 1*a* is inserted so as not to come off. On the surface side of the support member 12, as shown in FIG. 6, an inclination 16 is formed in the concave slot portion 15 and a pressure sensitive weak adhesive layer 17 is provided along a longitudinal direction of the claws 13.

With the above structure, the stamp plate 1 is assembled to the support member 12 by inserting one end (1*b*) of the stamp plate 1 along the inclination 16 into the concave slot portion 15 and then pushing the stamp plate 1 between the pair of claws 13 so as to stick the back surface of the plate 1 to the adhesive layer 17 between the pair of claws 13. In this way, the side opposite faces 1*a* or the lateral edge corner portions of the stamp surface 2 can elastically be engaged with the claws 13.

Accordingly, the back face of the stamp plate 1 is thus fixed to a part of a support plane 12*a* of the support member 12 by a weak adhesive strength of the pressure sensitive weak adhesive layer 17. The side opposite faces 1*a* and 1*a* are engaged with the pair of claws 13 and 13 of the support member 12. The end face 1*b* of the stamp plate 1 is fixed in the concave slot portion 15. Thus, the stamp plate 1 is securely assembled in the support member 12 and prevented from coming off.

Figure 7:
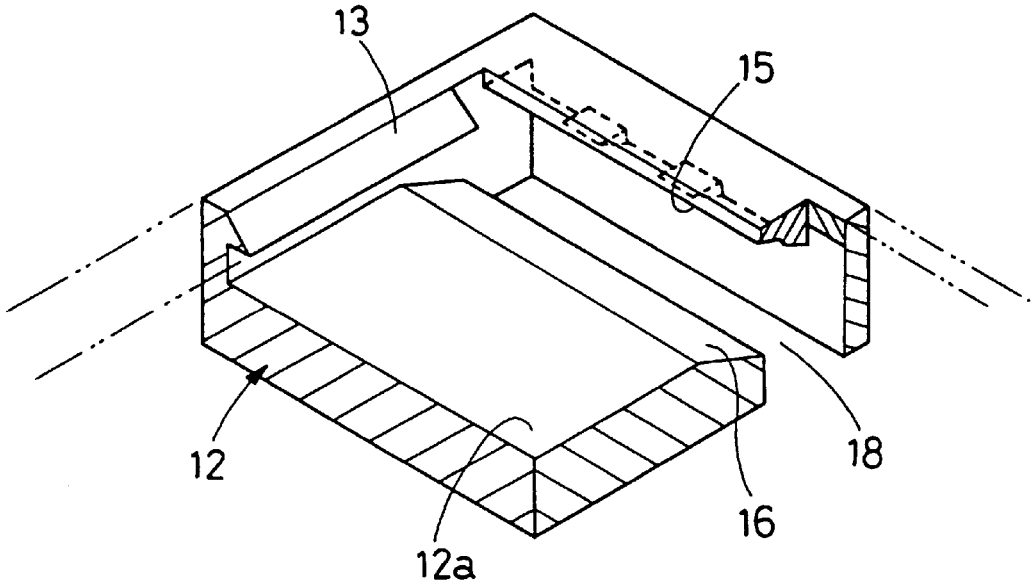
FIG. 7 is a partial perspective view of the support member.
Figure 8:
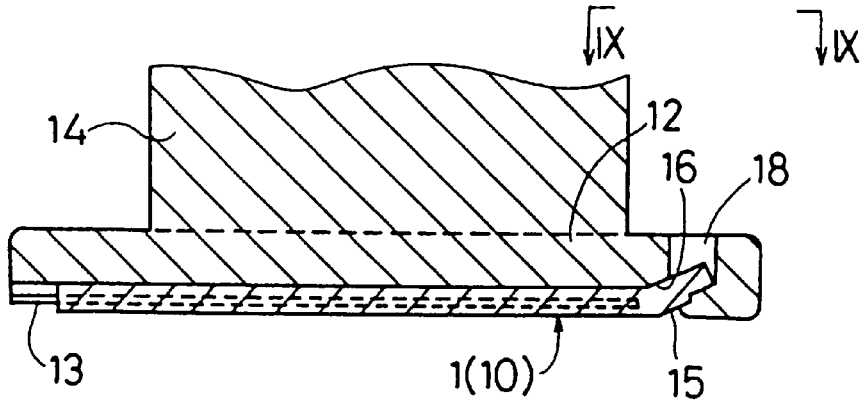
FIG. 8 is a side sectional view of the stamp plate assembled with the support member.
Figure 9:
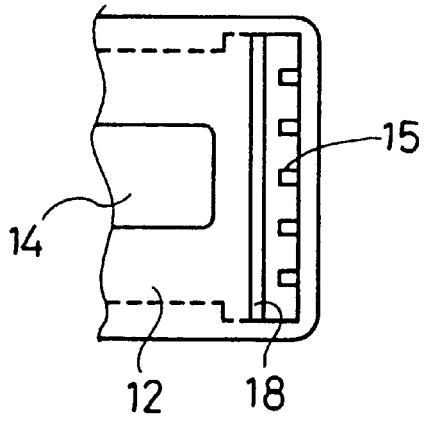
FIG. 9 is a partial view of FIG. 8 viewed along a IX—IX line.

The claws 13 may be formed longitudinally continuously along the side faces 1*a* (see FIG. 6) and, alternatively, formed intermittently so as not to partially hold the side faces 1*a*. As shown in FIGS. 7 through 9, an open hole 18 may be made in the concave slot portion 15 so as to go through a part of the support member 12.

Next, the porous base plate was produced while variously changing the pore diameter (size), hardness, thickness and annealing temperature thereof, and both the stamp plate 1 and the processed stamp plate 10 were produced from the porous base plate. Further, various stamping characteristics were experimented while using the stamp plate 1 and the processed stamp plate 10.

First, the relation between the average pore diameter and the melting characteristic, stamp concentration was examined by using the processed stamp plate 10 produced from the porous base plates in which the pore diameters were variously changed. Here, the pore diameter (size) can be changed by changing mixing ratio of polybutadiene and dibutyl phthalate or cooling temperature in molding. The experimental results are indicated in the table of FIG. 10. In FIG. 10, the melting characteristic was appreciated by visually observing clearness of the stamped characters which were actually stamped by the processed stamp plate 10, the clearness being dependent on sealing state of the melted-solidified portion 7 on the stamp surface 2. The stamp concentration was appreciated as follows. First, ink of a predetermined amount (0.15 g) was coated on the processed stamp plate 10 and stamping operation was conducted thirty (30) times on a plain paper under stamping pressure of 4 kgf at 25° C. Further, concentration of characters stamped at the thirtieth stamping operation was measured by Macbeth permeation densitometer. As ink used for the processed stamp plate 10, it was used ink in which oil soluble dye was dissolved in polyoxyethylene alkyl phenylether as organic solvent having good affinity with rubber material.

In FIG. 10, the melting characteristic is satisfactory until the pore diameter is 40 $\mu$m, and gradually decreases when the pore diameter becomes more than 40 μm, further is out of permissible range when the pore diameter exceeds 50 μm. The reason is as follows. If the average pore diameter is small, the melted-solidified portion 7 with good sealing property can be formed since the stamp surface 2 is enough melted by the thermal head. But, according to that the average pore diameter becomes larger, sealing property goes down, thus the border between the figure portion 6 and the melted-solidified portion 7 becomes unclear and the stamped characters also becomes unclear.

As the stamp concentration, if the average pore diameter is less than 10 μm, concentration value becomes less than 0.75 and the concentration goes down. On the other hand, if average pore diameter is more than 10 μm, the concentration value more than 0.75 can be obtained. The reason is as follows. If the average pore diameter is small, ink retaining ability becomes unsatisfactory. But, according to that the average pore diameter becomes larger, ink retaining ability becomes satisfactory.

Therefore, taking both the melting characteristic and the stamp concentration into consideration, it is preferable that the average pore diameter of the porous base plate lies in a range of 10 μm–40 μm, more preferably in a range of 15 μm–42 μm. The most preferable value of the average pore diameter is 20 μm.

Next, the relation between the hardness and the deformation amount of the figure portion 6 in melting, the melting characteristic, the stamping load force was examined by using the processed stamp plate 10 produced from the porous base plates in which the hardness was variously changed. Here, the hardness can be changed by changing mixing ratio of polybutadiene and dibutyl phthalate or the average pore diameter under various cooling temperatures in molding. The experimental results are indicated in the table of FIG. 11. In FIG. 11, the hardness was measured in the porous base plate with 10 mm thickness by means of ASKER C-type hardness meter. The deformation amount of the figure portion 6 in melting was appreciated by visually observing deformation amount (distortion of the characters) of the figure portion 6 formed on the stamp surface 2 by the thermal head. The melting characteristic was appreciated by the same method mentioned above. The stamping load force was appreciated on the basis of pressure to be applied to the stamp device 11 so that the concentration value measured by Macbeth permeation densitometer became approximately 0.8.

In FIG. 11, as the deformation amount of the figure portion 6 in melting, if the hardness is less than 10°, the deformation amount of the figure portion 6 becomes large. The reason is as follows. If the hardness is low, the figure portion 6 is apt to deform when the thermal head contacts to the stamp surface 2. As a result, if the thermal head is scanned on the stamp surface 2, the figure portion 6 is easily deformed. Further, according to that the hardness becomes higher than 20°, the deformation amount of the figure portion 6 becomes small. The reason as follows. If the hardness is high, the stamp surface 2 can overcome the pressure by the thermal head and the stamp surface 2 is scarcely deformed.

As the melting characteristic, if the hardness is less than 20° and exceeds 50°, the melting characteristic goes down in comparison with the permissible range. On the other hand, if the hardness lies in a range of 20°–50°, the melting characteristic becomes satisfactory. The reason that the melting characteristic goes down in case of less than 20° of the hardness is as follows. In this case, the stamp surface 2 is apt to deform when the thermal head contacts thereto, as a result, clearness of the characters goes down on the basis of deformation in the figure portion 6. The reason that the melting characteristic goes down in case of more than 50° of the hardness is as follows. In this case, contact force between the thermal head and the stamp surface 2 becomes large, and due to this circumstance, the thermal head is apt to partially contact to the stamp surface 2. Therefore, there will partially occur non-melted portions, as a result, the melting characteristic goes down.

Further, as the stamping load force, if the hardness is less than 50°, the stamping load force becomes less than 5 kgf. This stamping load force is suitable for the stamp device 11. On the contrary, if the hardness becomes more than 60°, the stamping load force becomes more than 5 kgf which is not suitable for the stamp device 11.

Therefore, taking into consideration the deformation amount of the figure portion 6, the melting characteristic and the stamping load force, it is preferable that the hardness of the porous base plate lies in a range of 20°–50°, more preferably in a range of 30°–40°. The most preferable value of the hardness is 35°.

In addition to the above, when the processed stamp plate 10 is produced through the stamp plate 1 from the porous base plate while variously changing the thickness of the porous base plate, the relation between the thickness of the porous base plate and strength of the stamp surface 2 (stamp surface strength), the handling characteristic of the processed stamp plate 10 (handling ability), the cost was examined. The experimental results are indicated in the table of FIG. 12. The stamp surface strength was appreciated by visually observing whether the porous base plate was broken when the melted-solidified portion 7 is formed by contacting the thermal head on the stamp surface 2. The thickness of the porous base plate can be changed by changing the thickness dimension of the plate with a mold used when molding the porous base plate.

In FIG. 12, as the stamp surface strength, if the thickness of the porous base plate is less than 1 mm, it was found that the porous base plate broke. And if the thickness thereof is more than 1.6 mm, the stamp surface 2 with satisfactory stamp surface strength can be obtained without breaking the porous base plate. The reason is as follows. If the porous base plate is excessively thin, the thermal head partially contacts to the stamp surface 2 since the thermal head is scanned on the stamp surface 2 while contacting thereto when the melted-solidified portion 7 is formed. As a result, the stamp surface 2 is extended and apt to be broken.

As the handling ability, if the thickness of the porous base plate is less than 1 mm, the handling ability goes down. If the thickness thereof is more than 1.6 mm, the handling ability is not enough yet. But, if the thickness thereof becomes more than 2 mm, the handling ability becomes satisfactory. The reason is as follows. The processed stamp plate 10 is pressed into the concave slot portion 15 of the support member 12. Thus, if the thickness thereof is small, it is difficult to press the processed stamp plate 10 into the concave slot portion 15. And if the processed stamp plate 10 is thin, it is conceivable that the processed stamp plate 10 is out of the concave slot portion 15 when melted by the thermal head.

Further, as the cost, if the thickness of the porous base plate is small, the cost thereof becomes, of course, low. Thus, if the thickness thereof exceeds 4 mm, cost performance goes down.

Therefore, taking into consideration the stamp surface strength, the handling ability and the cost, it is preferable that the thickness of the porous base plate lies in a range of 1 mm–4 mm, more preferably in a range of 2 mm–2.5 mm.

Next, when the processed stamp plate 10 is produced through the stamp plate 1 from the porous base plate while variously changing the annealing temperature, it was examined the relation between the annealing temperature of the porous base plate and the stamp concentration, the dimension stability against time passage, the resisting characteristic against environmental temperature. The experimental results are indicated in the table of FIG. 13. The stamp concentration was appreciated by the same method mentioned above. That is, ink of a predetermined amount (0.15 g) was coated on the processed stamp plate 10 and stamping operation was conducted thirty (30) times on a plain paper under stamping pressure of 4 kgf at 25° C. Further, concentration of characters stamped at the thirtieth stamping operation was measured by Macbeth permeation densitometer. The dimension stability and the resisting characteristic were appreciated by actually measuring the deformation amount in the dimension of the porous base plate after being preserved under 45° C. for ten days.

In FIG. 13, as the stamp concentration, if the annealing temperature is less than 40° C., the stamp concentration slightly goes down. But, if the annealing temperature lies in a range of 50° C.–60° C., the stamp concentration becomes satisfactory. If the annealing temperature exceeds 60° C., the stamp concentration extremely goes down. The reason is as follows. If the annealing temperature is less than 40° C., structural stability of the porous base plate is not enough. If the annealing temperature exceeds 60° C., the porous base plate is degraded and its quality goes down, thus it occurs bad influence to the ink permeability or the stamp concentration.

Further, as the dimension stability and the resisting characteristic, if the annealing temperature is less than 40° C., there exists deficiency in both the dimension stability and the resisting characteristic. But, if the annealing temperature becomes more than 50° C., both the dimension stability and the resisting characteristic become satisfactory. The reason is as follows. In general, if the porous base plate is annealed under a predetermined temperature, such base plate can satisfactorily retain the dimension stability under the annealing temperature and the temperature lower than the annealing temperature, since the structure is stabilized. However, if the annealing temperature is less than 40° C., the structural stability of the porous base plate is not enough.

Therefore, taking into consideration the stamp concentration, the dimension stability and the resisting characteristic, it is preferable that the annealing temperature of the porous base plate lies in a range of 40° C.–60° C., more preferably in a range of 45° C.–55° C.

As mentioned in detail, in the stamp device 11 of the first embodiment, since the average pore diameter formed in the porous base plate is set in a range of 10 μm–40 μm, the melting characteristic of the stamp surface 2 can be improved when the figure portion 6 is formed, and the stamp concentration of characters stamped by the figure portion 6 can be stably retained.

Since the hardness of the stamp surface 2 in the porous base plate is set in a range of 20°–50° when measured by the ASKER TYPE C hardness meter, it can prevent the stamp plate 1 from being deformed when characters are stamped by the figure portion 6, thus characters can be clearly stamped. Further, the thermal head can uniformly contact to the stamp surface 2 when the figure portion 6 is formed on the stamp surface 2 by the thermal head, thus the border between the figure portion 6 and the melted-solidified portion 7 can be clearly formed.

Further, since the thickness of the porous base plate is set in a range of 1 mm–4 mm, the thermal head can uniformly contact to the stamp surface 2 without breaking the stamp surface 2 when the figure portion 6 is formed on the stamp surface 2 by the thermal head. Therefore, the border between the figure portion 6 and the melted-solidified portion 7 can be clearly formed and the stamp plate can be easily handled.

Since the porous base plate is annealed under a temperature range of 40° C.–60° C., the dimension of stamp plate can be retained for a long time under the annealing temperature and the temperature lower than it, thus the stamp plate 1 can retain the excellent dimension stability under the normal condition.

Figure 14:
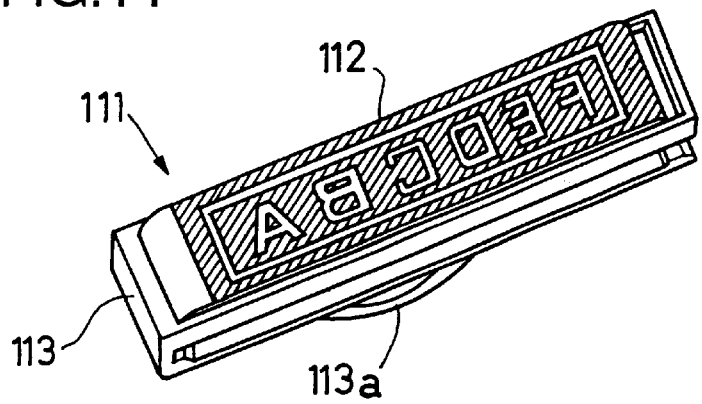
FIG. 14 is a perspective view of the stamp device according to the second embodiment.

Next, the stamp device according to the second embodiment will be described with reference to FIGS. 14, 15. In FIG. 14, a stamp device 111 has a stamp plate 112 formed from a rectangular sheet of stamp material, and a stamp support 111 supporting the back surface of the stamp plate 112. In the. stamp support 113, a hand-hold portion 113*a* is formed at the opposite side where the stamp plate 112 is retained.

As the stamp material used for the stamp plate 112, it is preferable to use the porous base sheet (plate) such as foamed resin sheet which can impregnate ink therein, the hardness thereof lying in a range of 20°–60°, more pereferably 30°–40°, under 25° C. and the contact pressure against the thermal head 65 (mentioned later) being set in a range of 0.1–0.5 N/mm , more preferably 0.1–0.3 N/mm per unit length. In detail, for example, it is used the porous base sheet; the hardness is 35° under 25° C.; main component is polybutadiene rubber which is used as rubber material; the open cells are formed with the average pore diameter of 20 μm; the thickness is 2–2.5 mm.

Figure 15:
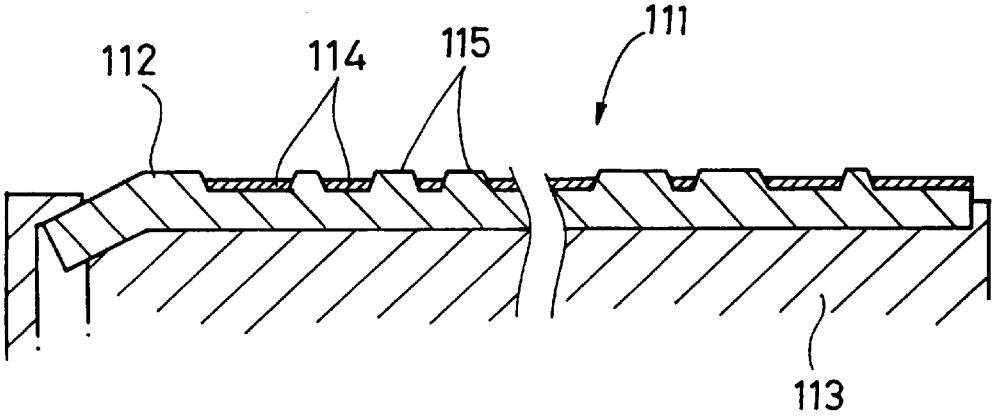
FIG. 15 is a partially enlarged sectional view of the stamp device shown in FIG. 14.

On the surface of the stamp plate 112, there are formed the melted-solidified portion 114 which is formed by melting and solidifying the surface pores and becomes ink impermeable, and the non-melted portion 115 (figure portion) which is formed without melting the surface pores and becomes ink permeable, as shown in FIGS. 14, 15. Thus, since ink impregnated in the stamp plate 112 can run from only the non-melted portion 115, characters, figures formed by the non-melted portion 115 are stamped when the stamp plate 112 is pressed onto the stamp sheet.

As the stamp plate producing apparatus of the second embodiment, the stamp producing apparatus used in the first embodiment is basically utilized. Thus, since such stamp producing apparatus is described in detail with reference to FIGS. 3–5, its description will be omitted. In the second embodiment, the stamp plate producing apparatus has a characteristic structure as follows. Such structure will be described with reference to FIG. 16.

Figure 16:
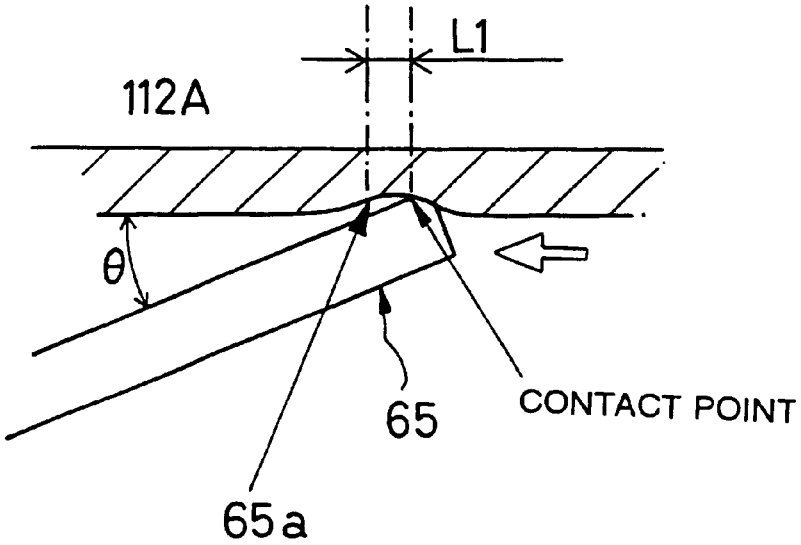
FIG. 16 is an explanatory view showing the relation between the porous base plate and the thermal head.

In FIG. 16, length between the contact point of the porous base plate 112A and the thermal head 65 and the dot heating element 65*a* is defined by the length L1, and this length L1 is set so as to become in a range of 0–1.0 mm more preferably 0–0.4 mm, from the contact point to the downstream side along moving direction of the thermal head 65. At that time, the dot heating element 65*a* of the thermal head 65 contacts to the surface of the porous base plate 112A with a contact angle θ.

Further, experimental example will be described. First, the porous base plate 112A with the following characteristics was prepared. The characteristics are; the hardness is 35° under 25° C. when measured by ASKER TYPE C hardness meter; main component is polybutadiene rubber; the average pore diameter is 20 μm in open cells; the thickness is 2 mm–2.5 mm. The thermal head 65 is contacted to the above porous base plate 112A with the contact angle 13°. At that time, the thermal head 65 was set so that the length L1 became 0.38 mm. The contact pressure of the thermal head 65 was 3.9 N against the porous base plate 112A having the width of 16.9 mm, and deformation amount of the porous base plate 112A was 0.3 mm. Under the above condition, it was not found that the thermal head 65 partially contacted to the porous base plate 112A and the porous base plate 112A was extended toward the moving direction of the thermal head 65. Thus, after the stamp plate 112 was produced, distortion in the figure portion 115 was not found in the stamp plate 112.

Figure 17:
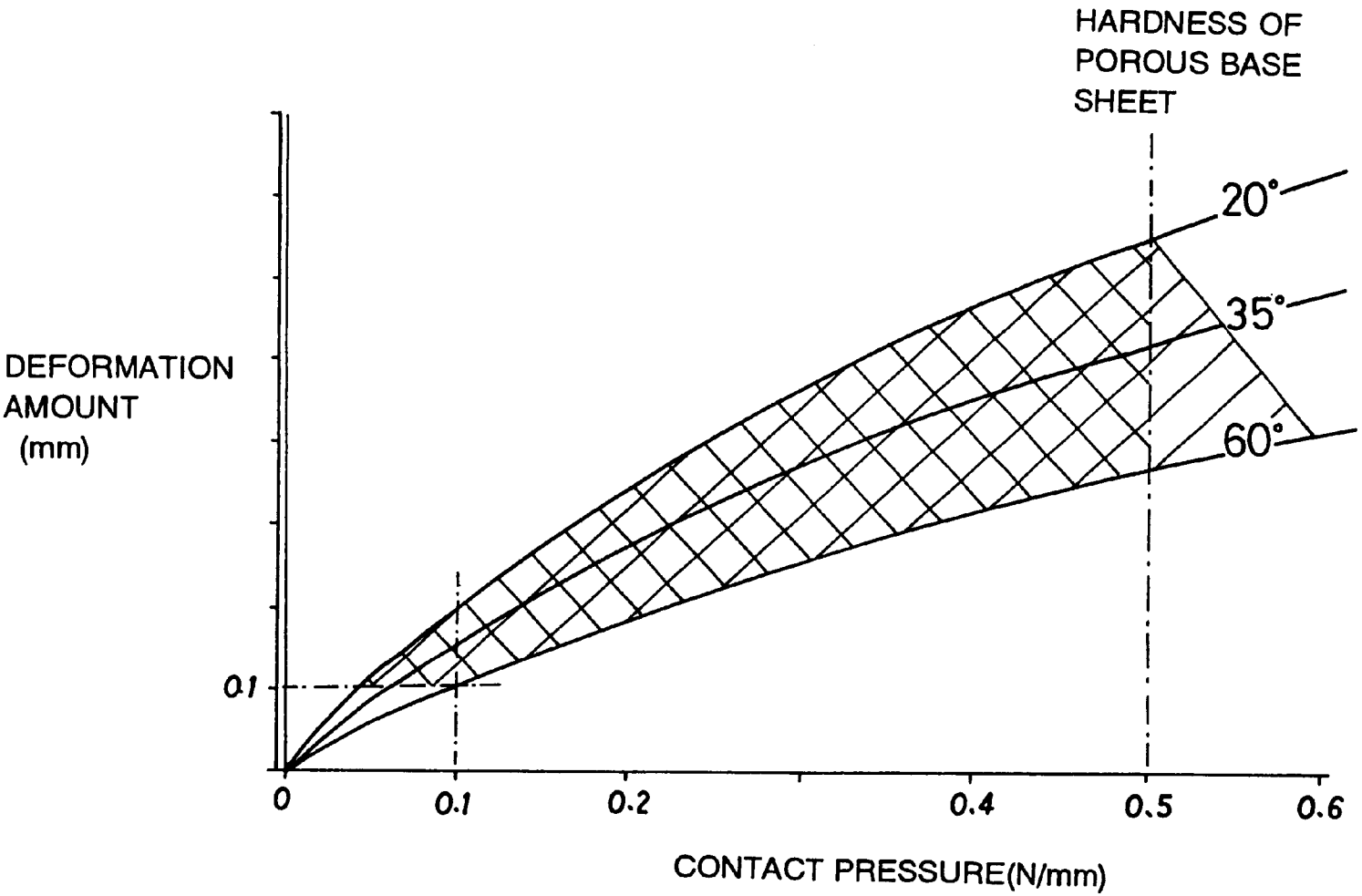
FIG. 17 is a graph showing the relation between contact pressure and the hardness, deformation amount of the porous base plate.

Next, the relation between the contact pressure and the hardness, the deformation amount of the porous base plate 112A was examined. The result is shown in FIG. 17. As shown in FIG. 17, if the contact pressure between the thermal head 65 and porous base plate 112A is less than 0.1 N/mm and the hardness of the porous base plate 112A exceeds 60°, the deformation amount becomes less than 0.1 mm. In this case, it is possible that parallelism between the thermal head 65 and the porous base plate 112A fluctuates and the thermal head partially contacts to the porous base plate 112A. On the other hand, if the contact pressure between the thermal head 65 and porous base plate 112A exceeds 0.5 N/mm and the hardness of the porous base plate 112A is less than 20°, the deformation amount becomes too large since the porous base plate 112A is dragged toward the moving direction of the thermal head 65. In this case, it is possible that the porous base plate 112A is out of retaining part and torsion in the figure portion 115 occurs. Therefore, it is preferable that the hardness of the porous base plate 112A lies in a range of 20°–60° under 25° C. and the contact pressure between the porous base plate 112A and the thermal head 65 lies in a range of 0.1–0.5 N.mm. This relation was confirmed.

Figure 18:
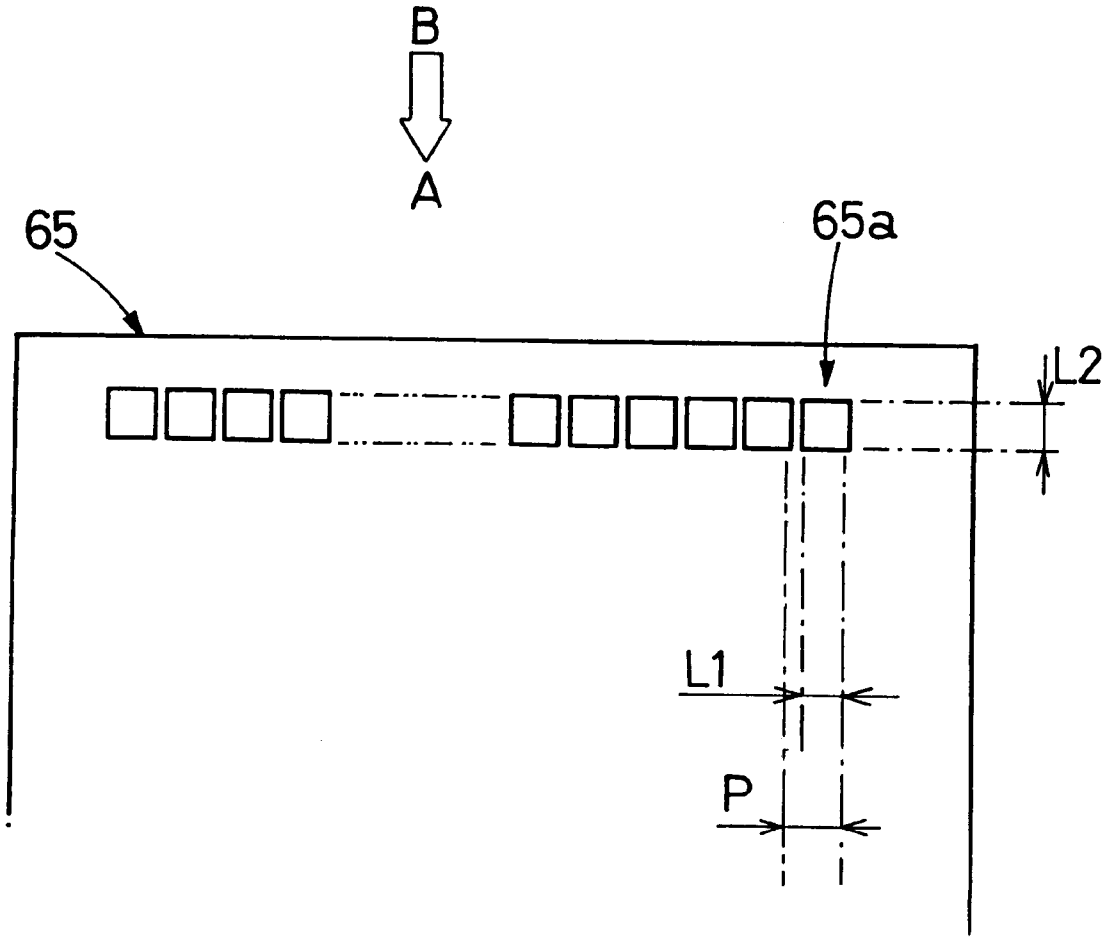
FIG. 18 is an explanatory view showing the relation between arrangement pitch of dot heat elements and dimension thereof in both the primary and secondary scanning directions, in the thermal head.

Next, the stamp plate producing apparatus of the third embodiment will be described. Here, the stamp device of the third embodiment is basically same as that of the second embodiment, thus its explanation will be omitted. Further, the stamp plate producing apparatus is also basically same as that of the second embodiment. In third embodiment, the following construction is different from the second embodiment. Such structural characteristic will be described with reference to FIG. 18. As shown in FIG. 18, in the thermal head 65, a plurality of dot heating elements 65*a* are arranged in a line perpendicular to the direction shown by the arrow A. The width H1 of the heat release plate 75, as shown in FIG. 5, is set so as to become slightly longer than the width of the porous base plate 12A. The width H1 corresponds to the row length of the dot heating elements 65*a*.

Figure 19:
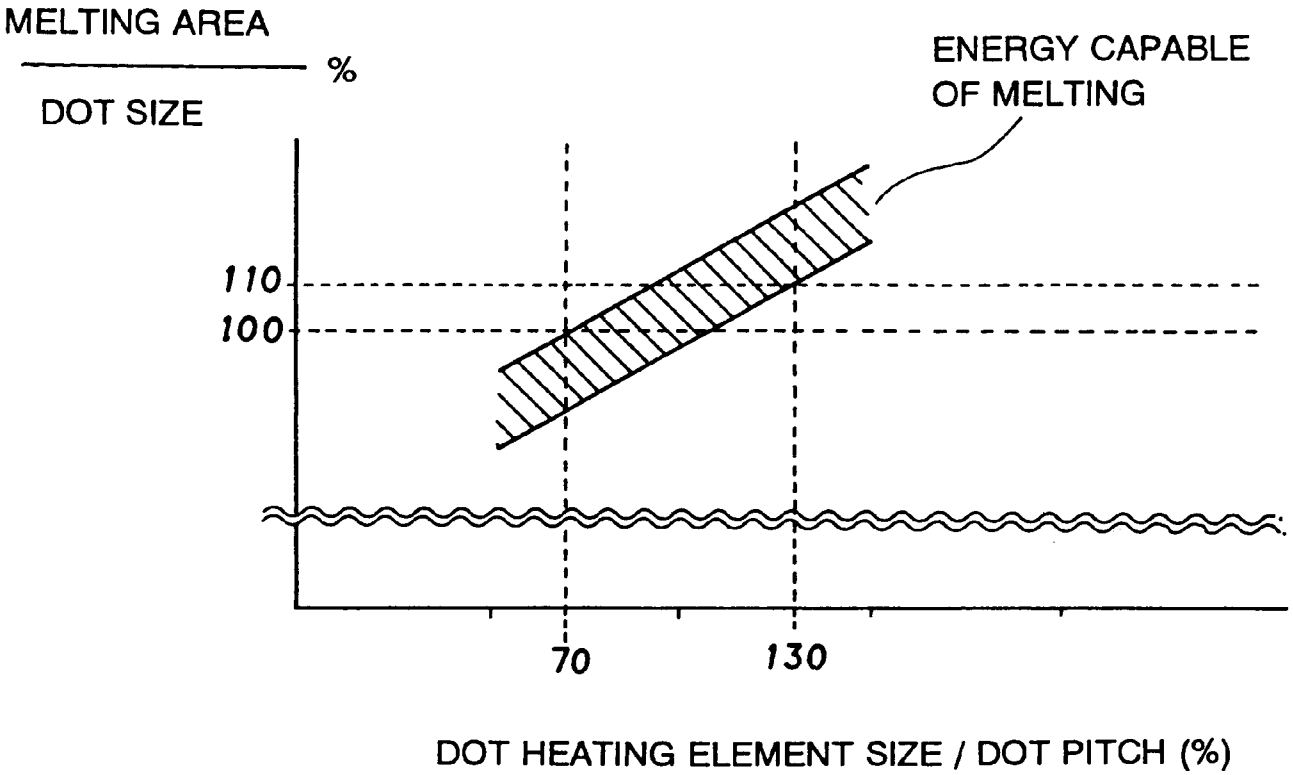
FIG. 19 is an explanatory view showing the relation between melting region/dot size and dot heating element size/dot pitch.
Figure 20:
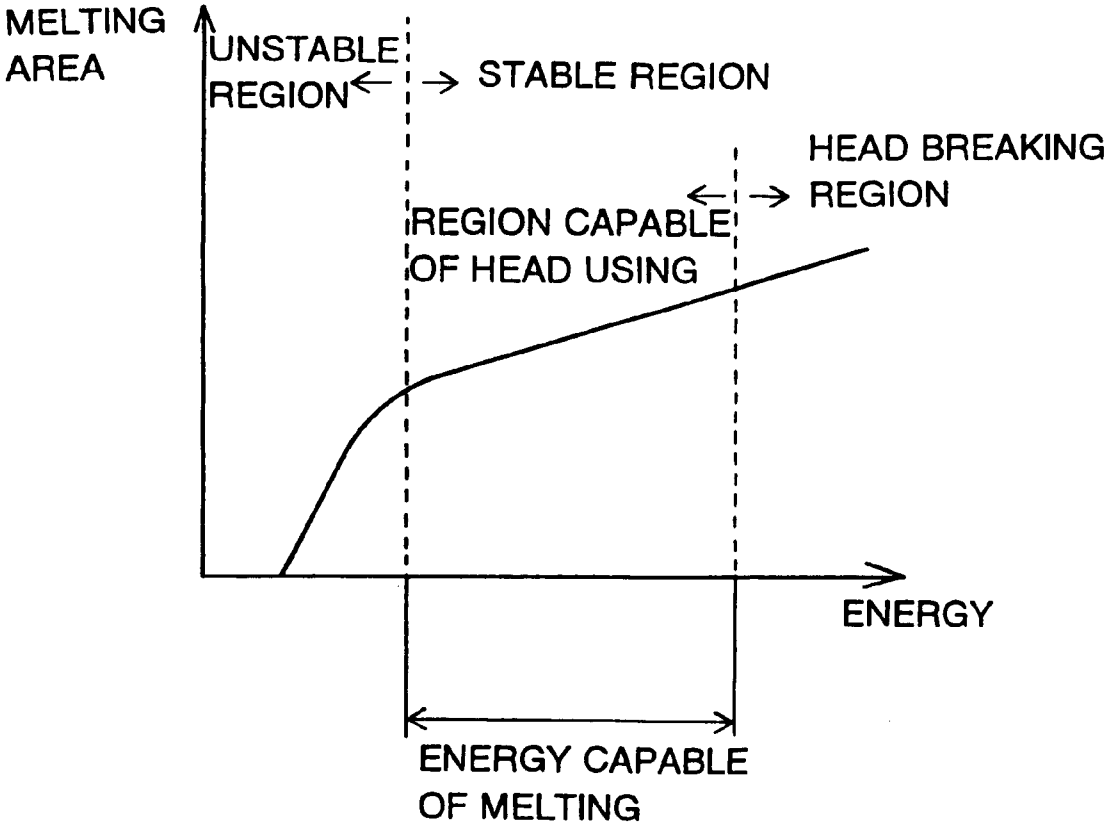
FIG. 20 is an explanatory view showing the relation between melting energy and melting region.
Figure 21A:
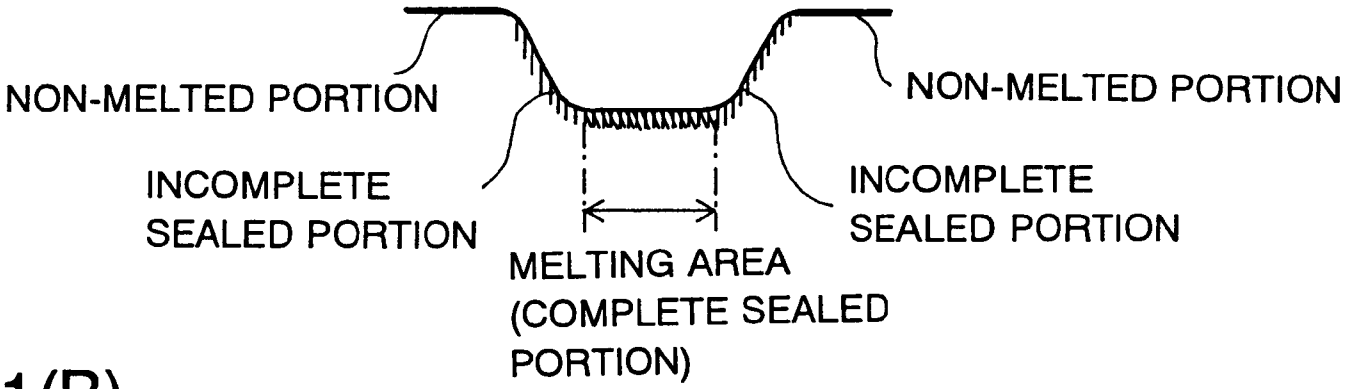
FIGS. 21(A) and 21(B) schematic views showing melting region.
Figure 21B:
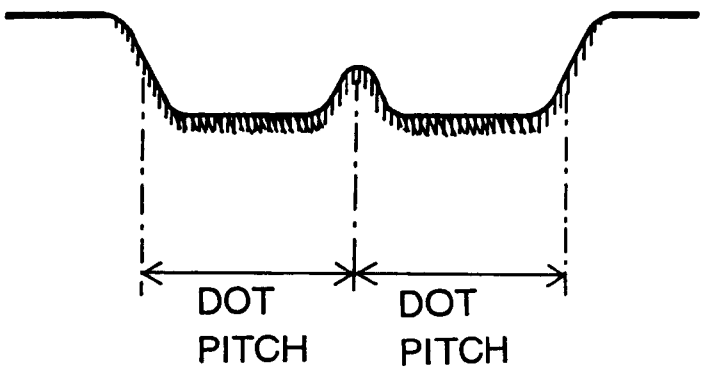
Figure 22:
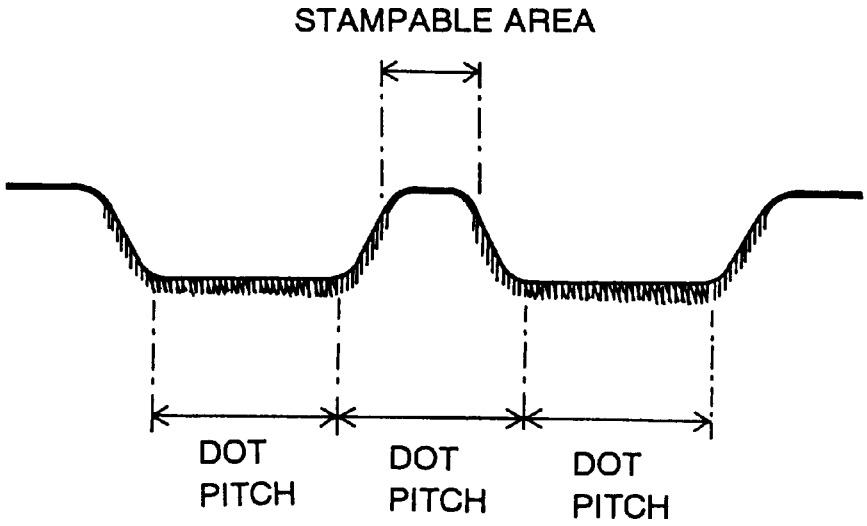
FIG. 22 is a schematic view showing a printable region.
Figure 23:
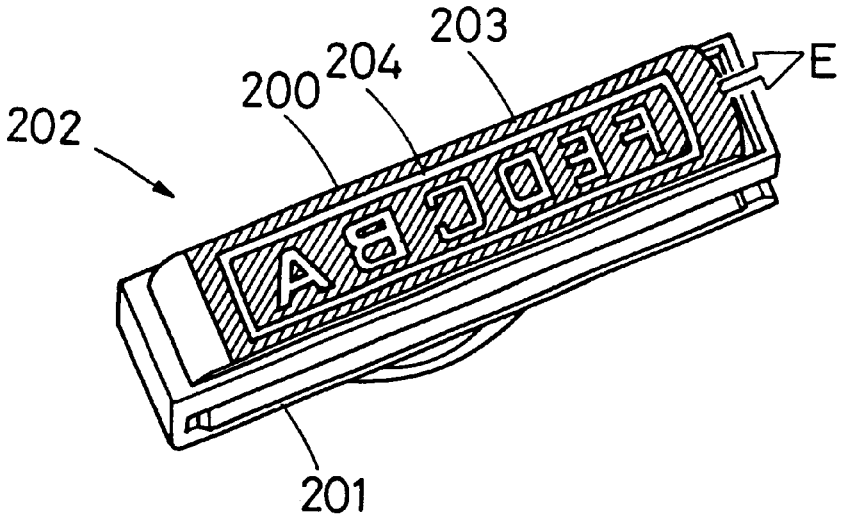
FIG.23 PRIOR ART
FIG. 23 is a perspective view of the stamp device in the prior art when the stamp plate is extended.
Figure 24:
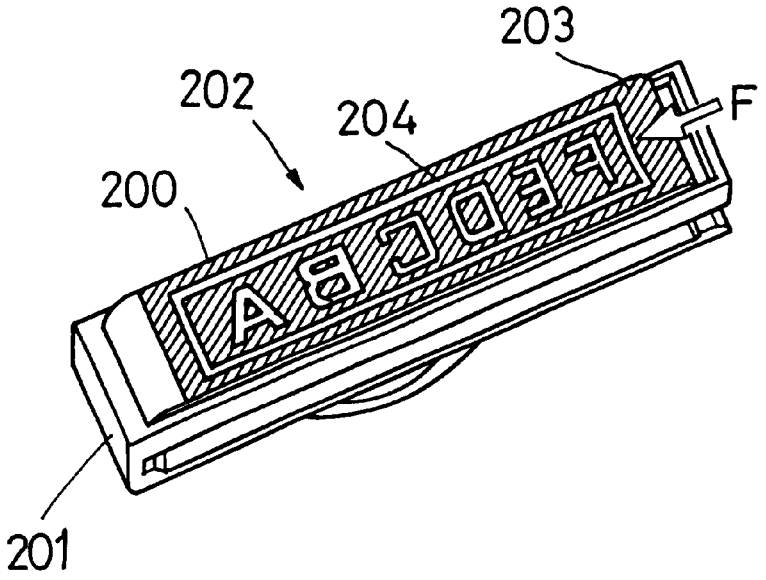
FIG.24 PRIOR ART
FIG. 24 is a perspective view of the stamp device in the prior art when the stamp plate is contracted.

The melting area by the dot heating element 65*a* is set in a range of 100%–110% of the dot (arrangement) pitch P between the elements 65*a*, and the width L1 of the dot heating element 65*a* in the primary scanning direction and the width L2 thereof in the secondary scanning direction are set in a range of 70%–130% of the dot pitch P. The reason is as follows. As shown in FIG. 19, considering the energy capable of melting (see FIG. 20) on the basis of the energy applied to the thermal head 65, the size (width L1, L2) of the dot heating element 65*a* necessary to completely seal the melted portion and remain the non-melted portion of the one dot area becomes in a range of 70%–100% of the dot pitch.

As the width L1 of the dot heating element 65*a* along the primary scanning direction, it is difficult to form it with a size larger than the dot pitch, therefore it is preferable to set the width L1 of the element 65*a* in a range of 70%–130% of the dot pitch when producing.

Next, both the width L1 in the primary scanning direction and the width L2 in the secondary scanning direction will be concretely described.

(the width L2 in the secondary scanning direction)

The width L2 is set 0.140 mm against the feed pitch 0.141 mm of the thermal head. The reason is as follows. If the width L2 exceeds 0.183 mm, it becomes difficult to remain the non-melted portion corresponding to the one dot area. Further, if the width L2 is less than 0.099 mm, it concludes that the energy applied to the thermal head exceeds the rated power of the thermal head.

(the width L1 in the primary scanning direction)

The width L1 is set 0.125 mm against the feed pitch 0.141 mm of the thermal head. The reason is as follows. If the width L1 exceeds 0.141 mm, it becomes difficult to produce it. Further, if the width L1 is less than 0.099 mm, it concludes that the energy applied to the thermal head exceeds the rated power of the thermal head.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A stamp plate producing apparatus for producing a stamp plate, the stamp plate made from a porous base plate having a stamp surface on which an ink permeable non-melted portion and an ink impermeable melted-solidified portion are formed, the stamp plate producing apparatus comprising a thermal head with a plurality of dot heating elements, a portion of the thermal head contacting the stamp plate at a contact point on one surface of the porous base plate and selectively heating and melting the surface of the porous base plate, wherein said plurality of dot heating elements are arranged on the thermal head with an arranging pitch and each dot heating element has a predetermined size in both a primary scanning direction defined by the dot heating elements of the thermal head and a secondary scanning direction transverse to the primary scanning direction and the predetermined size is set in a range of 70%–130% of the arranging pitch.

2. The stamp plate producing apparatus according to claim 1, wherein each dot heating element has an area capable of melting the porous base plate, the area being set in a range of 100%–110% of the arranging pitch.

3. The stamp plate producing apparatus according to claim 1, wherein the size of each dot heating element in the primary scanning direction is set in a range of 70%–100% of the arranging pitch.

4. The stamp plate producing apparatus according to claim 1, wherein a distance between the contact point where the thermal head and the porous base plate contact and each dot heating element is set in a range of 0 mm–1.0 mm, when a hardness of the porous base plate lies in a range of 20°–60° as measured by an ASKER Type C hardness meter under 25° C.

5. The stamp plate producing apparatus according to claim 4, wherein the distance is set in a range of 0 mm–0.4 mm.

6. The stamp plate producing apparatus according to claim 4, wherein a contact pressure between the thermal head and the porous base plate is set in a range of 0.1 N/mm–0.5 N/mm.

7. The stamp plate producing apparatus according to claim 6, wherein the contact pressure is set in a range of 0.1 N/mm–0.3 N/mm.

* * * * *